US007292807B2

(12) United States Patent
Nowak et al.

(10) Patent No.: US 7,292,807 B2
(45) Date of Patent: Nov. 6, 2007

(54) ASSEMBLY AND METHOD FOR REDUCING SHAFT DEFLECTION

(75) Inventors: William J. Nowak, Webster, NY (US); David K. Shogren, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 360 days.

(21) Appl. No.: 11/100,146

(22) Filed: Apr. 6, 2005

(65) Prior Publication Data

US 2006/0228133 A1 Oct. 12, 2006

(51) Int. Cl.
*G03G 15/00* (2006.01)

(52) U.S. Cl. ..... 399/162

(58) Field of Classification Search ..... 399/162, 399/398, 164, 165, 329, 302, 308, 303, 312, 399/313; 474/133; 384/418, 452, 453; 492/16–20
See application file for complete search history.

(56) References Cited

U.S. PATENT DOCUMENTS 4,188,110 A 2/1980 Stange
4,221,480 A 9/1980 Spehrley, Jr.
4,487,122 A * 12/1984 George et al. ..... 101/153
4,512,170 A * 4/1985 Hsu ..... 72/11.7
4,552,073 A * 11/1985 Smith ..... 105/154
4,561,756 A * 12/1985 Lang ..... 399/315
5,276,485 A 1/1994 Osbourne et al.
5,421,255 A * 6/1995 Kryk ..... 399/162
5,515,139 A 5/1996 Hou et al.
5,553,805 A * 9/1996 Ruegg ..... 242/534
5,708,924 A 1/1998 Shogren et al.
5,966,572 A 10/1999 Mishra et al.
5,966,573 A 10/1999 Yu et al.
6,055,398 A 4/2000 Costanza et al.
6,088,559 A 7/2000 Costanza et al.
6,101,353 A 8/2000 Yu et al.
6,137,974 A 10/2000 Williams et al.
6,167,223 A 12/2000 Fiore et al.
6,338,453 B1 * 1/2002 Meyer ..... 242/598.3
6,360,982 B1 * 3/2002 Poppinghaus ..... 242/539
6,385,419 B1 5/2002 Genovese
6,494,071 B2 * 12/2002 Norikura ..... 72/12.7
6,516,942 B2 * 2/2003 East ..... 198/830

FOREIGN PATENT DOCUMENTS

JP 05072824 A * 3/1993

* cited by examiner

*Primary Examiner*—Robert Beatty
(74) *Attorney, Agent, or Firm*—Fay Sharpe LLP

(57) ABSTRACT

A shaft mounting and loading arrangement includes a shaft rotatably mounted within a frame of an imaging machine by a pair of spaced mounting bearings. A belt is entrained on the shaft between the bearings. The belt applies a belt load to the shaft along an axially length thereof. Loading is applied to the shaft at locations axially flanking the bearings to counteract deflection of the shaft caused by the belt load applied by the belt.

20 Claims, 6 Drawing Sheets

ASSEMBLY AND METHOD FOR REDUCING SHAFT DEFLECTION

BACKGROUND

Exemplary embodiments disclosed herein generally relate to electrostatographic imaging machines and, more particularly, to an assembly and method for reducing shaft deflection in a stripper roller employed within such a machine.

Flexible electrostatographic imaging members, including flexible electrostatographic imaging belts, are well known in the art. Typical electrostatographic imaging members include, for example, photoreceptors for electrophotographic imaging systems and electroreceptors such as ionographic imaging members for electrographic imaging systems. These imaging members generally comprise at least a supporting substrate layer and at least one imaging layer comprising thermoplastic polymer matrix material. The "imaging layer" as employed herein is generally defined as the dielectric imaging layer of an electroreceptor or the photoconductive imaging layer of a photoreceptor. In a photoreceptor, the photoconductive imaging layer may comprise only a single photoconductive layer or a plurality of layers such as a combination of a charge-generating layer and a charge transport layer.

Generally, in the art of electrophotography, the process of electrophotographic copying is initiated by exposing a light image of an original document onto a substantially uniformly charged photoreceptive member, such as a flexible electrostatographic imaging belts. Exposing the charged photoreceptive member to a light image discharges a photoconductive surface thereon in areas corresponding to non-image areas in the original document while maintaining the charge in image areas, thereby creating an electrostatic latent image of the original document on the photoreceptive member. This latent image is subsequently developed into a visible image by depositing charged developing material onto the photoreceptive member surface such that the developing material is attracted to the charged image areas on the photoconductive surface. Thereafter, the developing material is transferred from the photoreceptive member to a receiving copy sheet or to some other image support substrate, to create an image, which may be permanently affixed to the image support substrate, thereby providing an electrophotographic reproduction of the original document. In a final step in the process, the photoconductive surface of the photoreceptive member is cleaned with a cleaning device, such as elastomeric cleaning blade, to remove any residual developing material which may be remaining on the surface thereof in preparation for successive imaging cycles.

The electrostatographic copying process described hereinabove, for electrophotographic imaging, is well known and is commonly used for light lens copying of an original document. Analogous processes also exist in other electrostatographic printing applications such as, for example, digital laser printing where a latent image is formed on the photoconductive surface via a modulated laser beam, or ionographic printing and reproduction where charge is deposited on a charge retentive surface in response to electronically generated or stored images.

When employed in electrostatographic imaging machines, flexible electrostatographic imaging belts are typically rotatably mounted and driven to transport a receptor portion or surface of the belt (e.g., a photoreceptor surface for an electrophotographic imaging system or an electroreceptor surface for an electrographic imaging systems) through the various processing stations of the imaging machine. These processing stations can include, for example, uniformly charging the belt receptor surface, exposing the charged belt receptor surface to create a latent image on the belt receptor surface, developing the latent image by selectively depositing charged developing material onto the belt, transferring the developing material to a receiving sheet or some other image support substrate, and cleaning the belt to prepare the surface for a successive imaging cycle. To rotatably mount, drive and support the belt in the imaging machine, a number of backer bars and small diameter belt support rollers can be employed, including a tension roller for maintaining the belt under tension, at least one drive roller for driving the belt and a stripper roller.

In addition to rotatably mounting the belt within an imaging machine, the stripper roller functions to strip or separate the receiving sheet, or other image support substrate, from the belt after the developing material has been transferred from the belt to the receiving sheet. In particular, the stripper roller provides a sharp bend in the path of the rotating belt, such as about ninety degrees for example, which assists in separating or de-tacking of the receiving sheet after image transfer. After being stripped from the belt, the receiving sheet can be directed to or through a fuser for permanently affixing the image transferred from the belt to the receiving sheet.

Generally, smaller diameter stripper rollers tend to better perform their intended stripping function. However, smaller diameter stripper rollers also tend to be more flexible, particularly when the axial length of the stripper roller is required to be relatively long, such as may be needed for wide process width belts. Flexible stripper rollers are susceptible to bending caused by the load force applied to the stripper roller by a taught or well-tensioned belt. Bending of the stripper roller can result in poor belt tracking and the formation of wrinkles in the belt, which both can adversely affect the belt's ability to ultimately transfer an image to a receiving sheet. In contrast, larger diameter stripper rollers are less flexible and therefore bend less, but also have a reduced stripping capacity, particularly for lightweight sheets or substrates.

Heretofore, the competing design factors relating to stripper rollers led to the employment of a compromised stripper roller. The need for a smaller diameter stripper roller to better de-tack from the belt was balanced with the need for a more rigid (i.e., less flexible and bendable) stripper roller to prevent poor belt tracking and/or the formation of wrinkles in the belt. Accordingly, any improvements which allow stripper rollers to remain of smaller diameter, while simultaneously allowing stripper rollers to be less flexible and bendable under a belt load are considered desirable.

BRIEF SUMMARY

A shaft mounting and loading arrangement includes a shaft rotatably mounted within a frame of an imaging machine by a pair of spaced mounting bearings. A belt is entrained on the shaft between the bearings. The belt applies a belt load to the shaft along an axially length thereof. Loading is applied to the shaft at locations axially flanking the bearings to counteract deflection of the shaft caused by the belt load applied by the belt.

DETAILED DESCRIPTION

Figure 1:
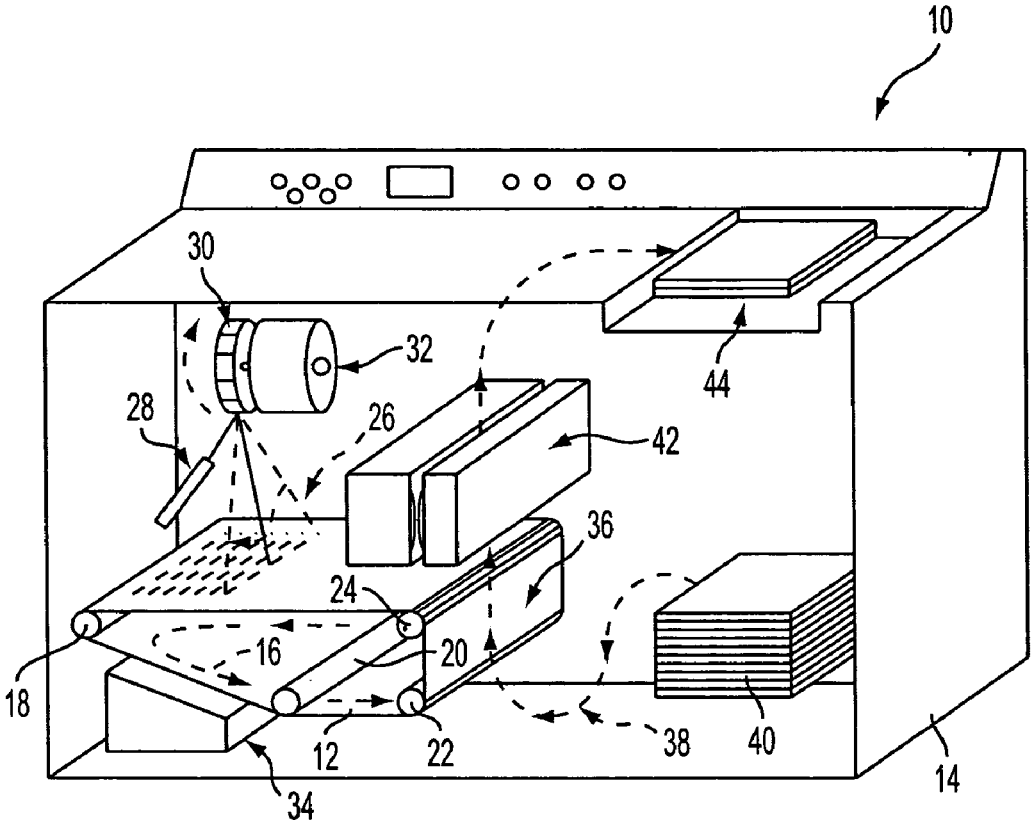
FIG. 1 is a schematic view of a electrostatographic printer having imaging belt mounted on a plurality of rotatable shafts or rollers, including a stripper roller.

Referring now to the drawings wherein the showings are only for purposes of illustrating one or more embodiments and not for limiting the same, an electrostatographic imaging machine 10 is schematically shown including a flexible electrostatographic imaging belt 12 rotatably mounted to or within a frame 14 of the imaging machine. In the illustrated embodiment, the imaging machine 10 is an electrostatographic printer of the monochrome variety, but it is to be appreciated by those skilled in the art that the machine 10 could alternately be any other type of imaging machine employing a flexible imaging belt, such as an electrostatographic copier or a multicolor imaging machine employing a transfer belt, for example. As is known and understood by those skilled in the art, the belt 12 of the illustrated embodiment can be made from a photoconductive material coated on a ground layer, which can also be, in turn, coated on an anti-curl backing layer.

In the schematically illustrated embodiment, the belt 12 is rotatably driven in a first direction, indicated by arrows 16, for advancing successive portions thereof sequentially through various processing stations disposed about the belt's path of movement, as will be described in more detail below. In particular, in the schematically illustrated embodiment, the belt 12 is entrained about a plurality of rollers, including tension roller 18, support or idler roller 20, drive roller 22 and stripper roller 24. Although not illustrated, the belt 12 can also be supported by one or more backer bars.

In operation, a portion of the belt 12 is charged to a relatively high, substantially uniform potential by a corona generating or other like device (not shown) prior to entering an exposure area or station 26. At the exposure station 26, an imager, such as a raster output scanner (ROS), includes a laser or laser generator 28 for generating and directing a collimated laser beam toward a polygon block member 30 having reflective facets. The polygon block member 30 can be rotatably driven by motor 32 for allowing the laser beam to scan transversely across the belt 12. The scanning laser beam is used to selectively dissipate the charge, or more specifically, portions of the charge, on the belt 12 for recording an electrostatic latent image on the belt which corresponds to a desired output image. A suitable controller (not shown) can be used to operate the ROS and ultimately create a desired electrostatic latent image on the belt 12.

After the latent image has been recorded on the belt 12, the belt is rotated to advance the latent image to a developer 34. Using commonly known techniques, toner, in the form of liquid or dry particles, is electrostatically attracted to the latent image on the belt 12 at the developer 34. More particularly, the latent image attracts toner particles from the carrier granules forming a toner powder image thereon. After the electrostatic latent image is developed, the toner powder image present on the belt 12 is advanced to transfer area or station 36.

A receiving sheet is fed toward the transfer station 36 along sheet path 38 from the top of a stack 40 of receiving sheets as is known and understood by those skilled in the art. The feeding of the receiving sheet along path 38 is timed so that the receiving sheet is at the transfer station 36 when the toner powder image formed on the belt 12 arrives at the transfer station 36. Specifically, the toner powder image contacts the advancing receiving sheet at the transfer station 36. The transfer station 36 can include a second corona generating device (not shown) which sprays ions onto the back side of the receiving sheet to attract the toner powder image from the belt 12 to the receiving sheet. Of course, as will be understood and appreciated by those skilled in the art, the transfer station can include alternate means or devices for moving toner from the belt 12 to the receiving sheet, such as, for example, bias transfer rolls or belts, or any other suitable device.

After transfer, the receiving sheet is detacked from the belt 12 by another corona generating device which sprays oppositely charged ions onto the back side of the sheet to assist in removing the receiving sheet from the belt 12. Additionally, the receiving sheet is stripped from the belt 12 as the belt moves sharply around the stripper roller 24 due to the relatively sharp radius of the stripper roller. After stripping, the receiving sheet can be directed to a fuser 42. Factors influencing the ease in which the receiving sheet is stripped from the belt 12 include the stiffness of the receiving sheet (which often directly corresponds to the thickness of the receiving sheet) and the diameter of the stripper roller 24. The stiffer the receiving sheet and the smaller the diameter of the stripper roller 24, the easier it is to strip the receiving sheet from the belt 12. Ease in stripping the receiving sheet from the belt 12 is desirable to lessen jams within the imaging machine 10.

After transfer, the receiving sheet passes through the fuser 42 wherein the image is permanently fixed or fused to the receiving sheet as is known and understood by those skilled in the art. The receiving sheet next moves to an output tray 44 where it can be retrieved from the machine 10. Of course, duplex operations could additionally be employed wherein the sheet could be inverted and then fed for recirculation back through the transfer station 36 and the fuser 42 for receiving and permanently fixing a side two image to the backside of that duplex sheet.

After the receiving sheet is separated from the belt 12, the residual toner/developer and paper fiber particles adhering to photoconductive surface of the belt 12 are removed therefrom by a suitable cleaning station (not shown). As is known by those skilled in the art, the cleaning station can include a rotatably mounted fibrous brush for contacting the belt 12 to disturb and remove paper fibers and a cleaning blade to remove any nontransferred toner particles. The blade may be configured in either a wiper or doctor position depending on the application. Subsequent to cleaning, an optional discharge lamp (not shown) floods the belt 12 with light to dissipate any residual electrostatic charge remaining thereon prior to the charging thereof for the next successive imaging cycle.

The various functions of the imaging machine 10 can be regulated by a controller (not shown), as is known by those skilled in the art. The controller is preferably a programmable microprocessor which controls all of the machine functions hereinbefore described. Additionally, the controller can provide a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may also be utilized to keep track of the position of the document and the copy sheets.

Figure 2:
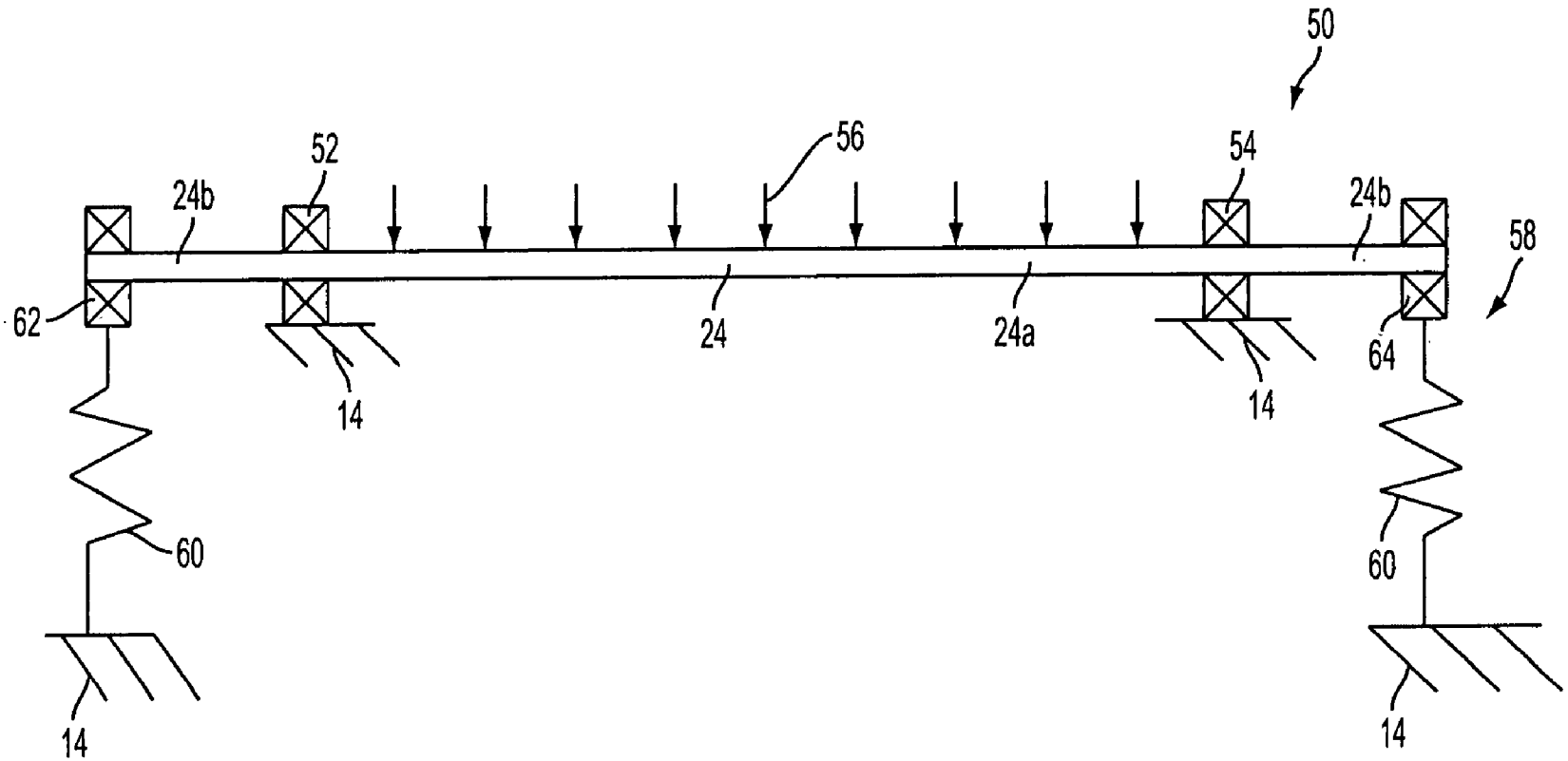
FIG. 2 is a schematic view of a loading and mounting arrangement for the stripper roller of FIG. 1.

With reference now to FIG. 2, a mounting arrangement 50 for the stripper roller 24, also referred to herein as a stripper shaft, is schematically shown. Though the mounting arrangement 50 is shown being used on monochrome imaging belt 12 in the illustrated embodiment, it is to be appreciated that such a mounting arrangement could be employed on a shaft supporting any belt in an imaging machine and should not be limited to the belt 12 and stripper roller 24 of the illustrated embodiment. The mounting arrangement 50 includes the stripper roller or shaft 24 rotatably mounted to the frame 14 by a pair of axially spaced mounting or support bearings 52,54. Although not specifically illustrated in FIG. 2, the belt 12 is mounted or entrained on the stripper roller 24 between the bearings 52,54 and abruptly changes direction about the stripper roller 24. In one embodiment, the stripper roller 24 is formed of steel and has a diameter of about 20 mm to about 25 mm for more reliably detacking receiving sheets from the belt 12 at the location of the stripper roller 24.

More particularly, the belt 12 is entrained about the stripper roller 24 and rollers 18,20,22. Specifically, the belt 12 is mounted on and engages a belt section 24*a* of the stripper roller defined between the bearings 52,54. Tension roller 18 applies a tension to the belt 12 to maintain the belt 12 in frictional engagement with the rollers 18-24 which, in turn, applies a uniform load (i.e., a belt load) to the stripper roller belt section 24*a*, as indicated by load force arrows 56. Belt load 56 urges the stripper roller 24 to deflect in a first direction. The mounting arrangement 50 further includes a loading arrangement 58 that minimizes or at least reduces deflection of the stripper roller 24 in at least the belt section 24*a* thereof. In the illustrated embodiment, the loading arrangement 58 includes adding or applying a load force or counteracting force means to overhung end sections 24*b* of the stripper roller 24. The loading to counteract the belt load urges the stripper roller 24 to deflect in a second, opposite direction against the urging of the belt load.

Specifically, the loading arrangement 58 of the illustrated embodiment includes bias members, such as springs 60 extending between the overhung end sections 24*b* and the frame 14. The springs 60 can be rotatably connected to the end sections 24*b* by load bearings 62,64 which are axially spaced, respectively, from the support bearings 52,54 and thereby axially flank the support bearings. The springs 60 can be fixedly connected to the frame 14 such that each spring applies a fixed load to the stripper roller 24 through the bearings 62,64 thereby inducing end moments to the roller 24.

As should be appreciated and skilled by those skilled in the art, other loading arrangements are contemplated and should be considered as being within the scope of the claims appended hereto. For example, one or more masses could be added, such as by hanging, to the end sections 24*b* of the stripper roller 24 to, with the assistance of gravity and proper orienting, apply axially spaced loading and end moments to the stripper roller. In another example, the springs 60 could be replaced by some other load bearing connection between the stripper roller end sections 24*b* and the frame 14. Still other alternate loading arrangements include using hydraulics to apply loading to the end sections 24*b*, fixing end sections 24*b* directly to the frame 14 at a preselected axial distance from the bearings 52,54, etc.

Figure 3:
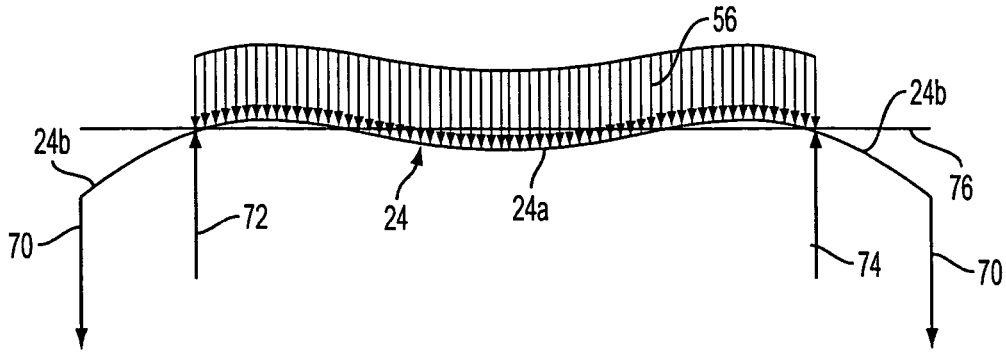
FIG. 3 is a schematic diagram of loading forces of the belt acting on the stripper roller with end loads applied to the stripper roller according to one embodiment.

With reference to FIG. 3, forces acting on the stripper shaft 24 as a result of the mounting and loading arrangements 50,58 are schematically illustrated. The load forces caused by the connection of the springs 60 to the end sections 24*b* and the frame 14 are indicated by arrows 70. The belt load forces are again indicated by arrows 56 and the equal and opposite forces exerted by the bearings 52,54 are indicated by arrows 72,74. The load forces 70 compensate for deflection of the stripper roller 24 caused by belt load forces 56 by inducing additional deflection of the stripper roller 24 that counteracts the deflection caused by the belt 12. As shown, in the illustrated embodiment, the concentrated moments created by the load forces 70 creates a fourth order deflection shape in the stripper roller 24, i.e., the stripper roller 24 is shaped like an "m" as a result of the mounting and loading arrangements 50,58. The amount the stripper roller 24 deflects from axis 76 is relatively minimal.

Figure 4:
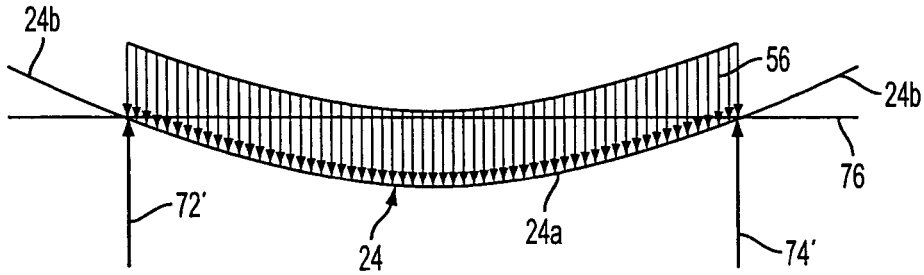
FIG. 4 PRIOR ART
FIG. 4 is a prior art schematic diagram of loading forces of the belt acting on the stripper roller without end loads applied to the stripper roller.

In contrast, with reference to FIG. 4, forces acting on a stripper roller 24 having a prior art mounting arrangement cause significantly more deflection of the stripper roller 24 from axis 76. In the prior art arrangement, the stripper roller 24 is simply supported by axially spaced bearings outside the belt section 24*a* and there is no end loading on the stripper roller end sections 24*b*. Thus, the bearings of this prior art mounting arrangement exert equal and opposite forces, indicated by arrows 72', that counteract only the belt force(s) 56. As shown, the resulting deflection of the stripper roller 24 having the prior art mounting and loading arrangement is second order in nature, i.e., the stripper roller 24 of the prior art mounting arrangement is shaped like a "u". Comparing FIGS. 3 and 4, the amplitude of the m-shaped deflection of FIG. 3 is substantially smaller than that of the u-shaped deflection of FIG. 4. The lower deflection of the stripper shaft 24 in the mounting and loading arrangements 50,58 has the advantage of reducing wrinkling of the belt 12 and improving belt tracking. This enables smaller diameter stripper shafts to be used which advantageously facilitate de-tacking of receiving sheets from the belt 12.

Figure 5:
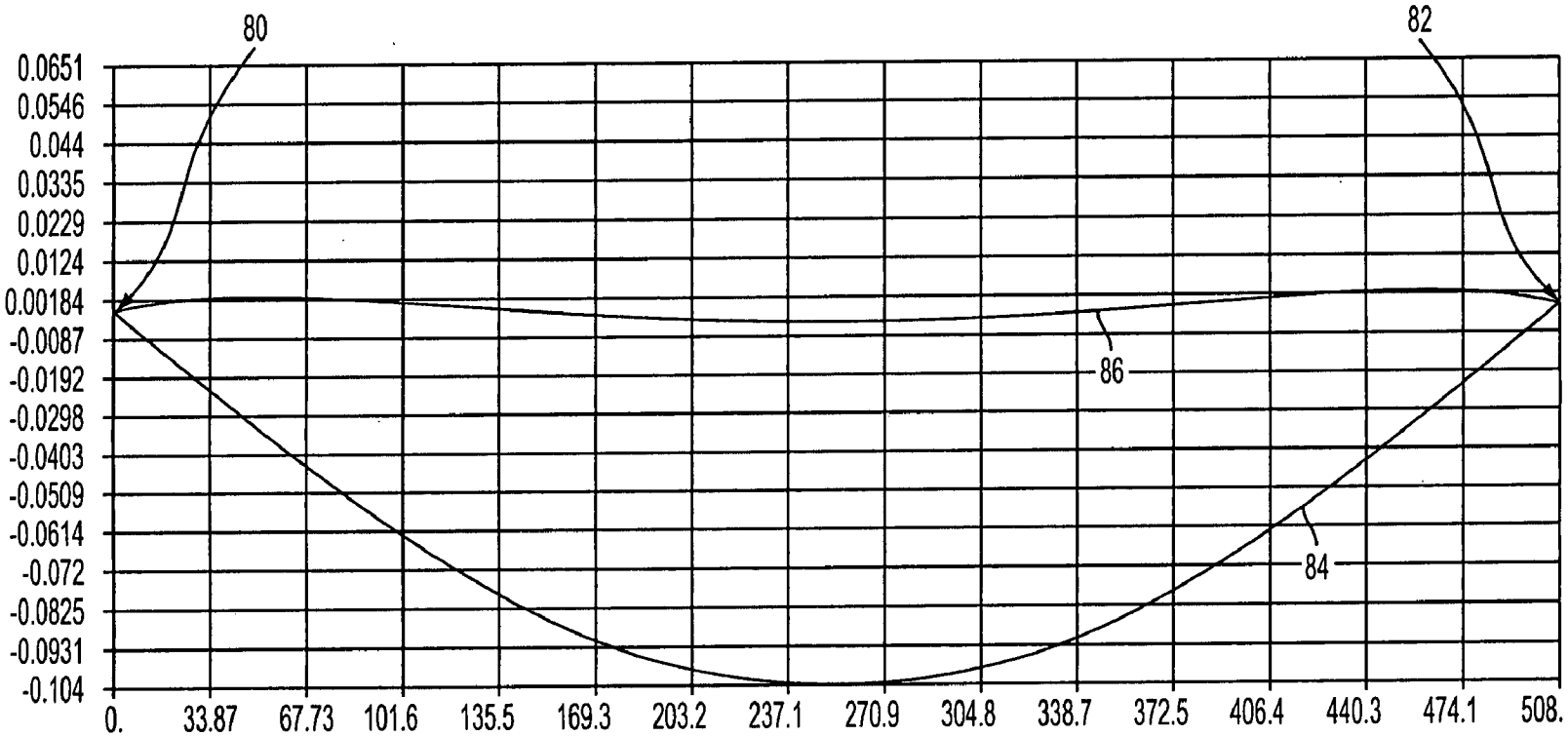
FIG. 5 is a comparison graph of deflection of the mounting and loading arrangement represented by FIG. 3 against deflection of the mounting and loading arrangement represented by FIG. 4.

In one simulated example, with reference to FIG. 5, a 20 mm diameter stripper roller was supported by support bearings (indicated at 80 and 82) spaced apart from one another by about 508 mm. A uniform belt load of 0.175 N/mm (1 lb/in) was applied to the 508 mm portion of the stripper roller between the support bearings 80,82. Deflection curve 84 represents deflection of only a simply supported stripper roller (similar to the mounting arrangements illustrated in FIG. 4) and shows a maximum deflection of 0.104 mm from an axis defined by the bearings 80,82. Deflection curve 86 represents deflection of a like stripper roller additionally having end moments applied thereto (similar to the mounting arrangements illustrated in FIGS. 2 and 3) for purposes of reducing deflection as described above.

The applied loading represented by deflection curve 86 is 5000 N-mm, i.e. 50 N at 100 mm outside each of the support bearing 80,82 (or 11 lbs. at 4 inches). As will be appreciated by those skilled in the art, the same moment could be produced by a higher load at shorter axial distances from the support bearings or a lower load at farther axial distances. As shown, deflection curve 86 has a maximum deflection of only 0.0005 mm, significantly less than that representing the stripper roller without end loading. To achieve the equivalent deflection of curve 86 with only a simply supported stripper roller, shaft diameter would need to increase to about 42.7 mm which would likely compromise the stripping capability of the stripper roller, especially when used with light weight and/or relatively thin receiving sheets.

Figure 6:
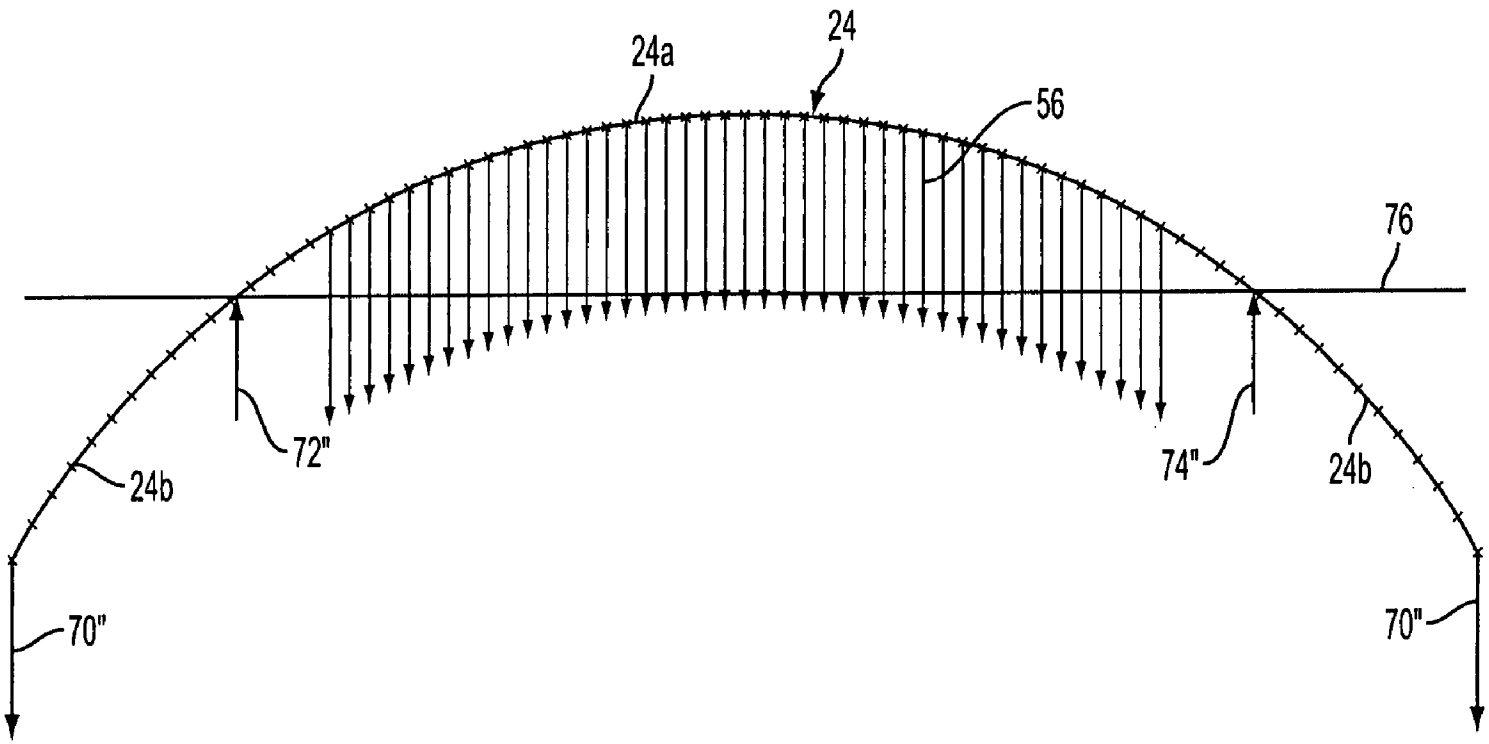
FIG. 6 is schematic diagram of loading forces of the belt acting on the stripper roller with end loads applied to the stripper roller according to another embodiment.

With reference to FIG. 6, forces acting on the stripper shaft 24 as a result of an alternate loading arrangement are schematically illustrated. The load forces applied to end sections 24*b* are indicated by arrows 70". The belt forces are still indicated by arrows 56 and the opposing bearing forces are indicated by arrows 72",74". In most respects, the loading arrangement represented by FIG. 6 is the same as the loading arrangement represented by FIG. 3 and like elements are indicated by like reference numerals. One difference between the loading arrangements is that the load forces 70 of FIG. 3 are intended to minimize deflection, whereas the load forces 70", which are greater than the load forces 70, significantly deflect the stripper shaft 24 convexly against the urging of the belt forces 56.

Figure 7:
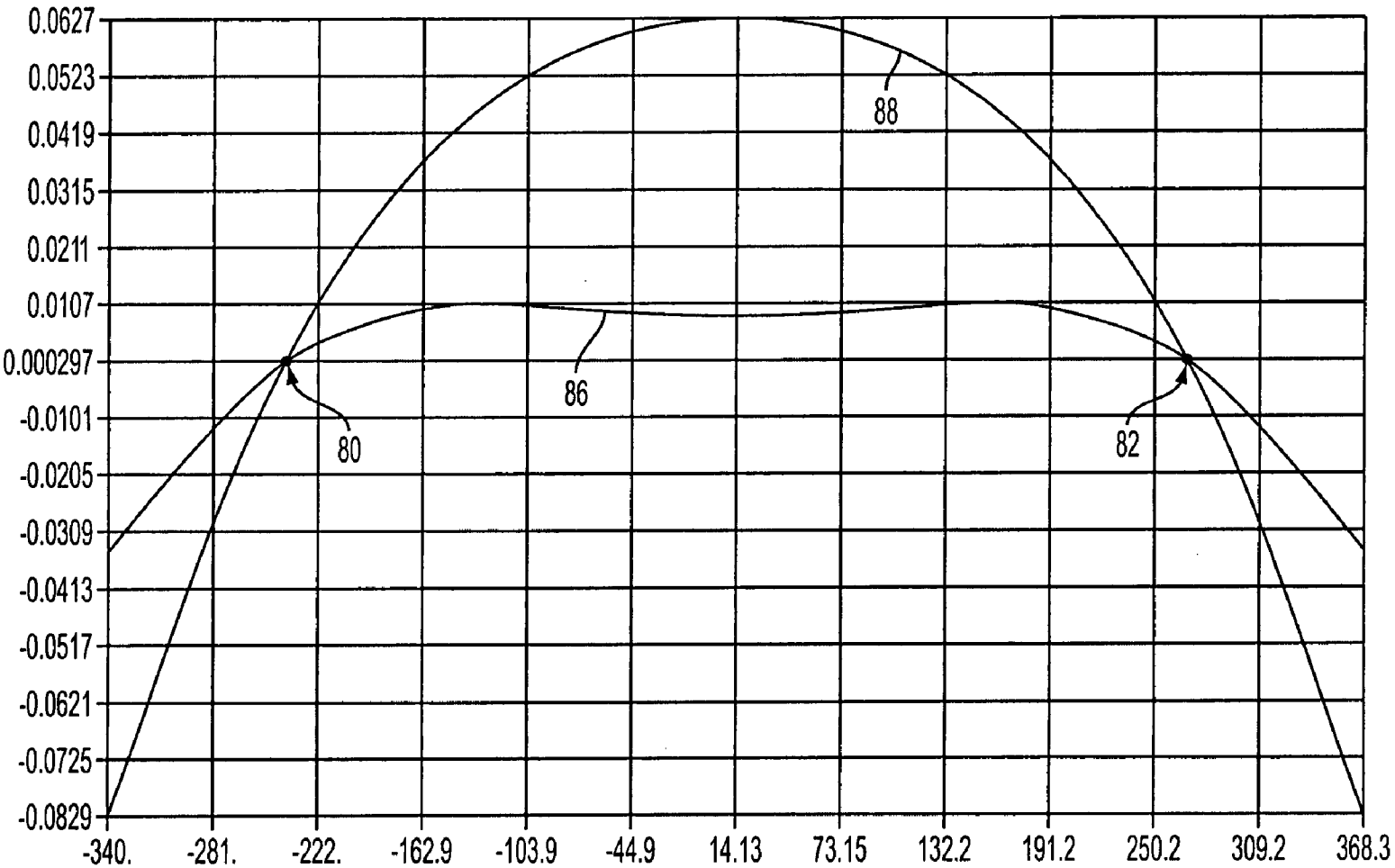
FIG. 7 is a comparison graph of deflection of the mounting and loading arrangement represented by FIG. 6 against deflection of the mounting and loading arrangement represented by FIG. 4.

The result of the load forces 70" is that the stripper roller 24 has a deflected profile that further facilitates tracking of the belt 12. As will be understood and appreciated by those skilled in the art, the crowning of the stripper roller 24 effect, illustrated in FIG. 6, will assist in maintaining the belt 12 tracking in a centered position relative to the stripper roller 24 and all rollers, such as rollers 18,20,22, aligned with the stripper roller. With reference to FIG. 7, the example of FIG. 5 is continued wherein a 20 mm diameter stripper roller is supported by bearings at 80,82 spaced apart from one another by 508 mm. The same uniform belt load of 0.175 N/mm (11*b*/in) was applied to the 508 mm portion between 80,82. Deflection curve 86 is again shown, but is compared to deflection curve 88. Deflection curve 88 represents deflection of a stripper roller having load forces applied to ends thereof that overhang relative to bearings 80,82 to create end moments (similar to FIG. 6) for purposes of creating a crown-shaped deflection as described above. The applied loading represented by deflection curve 88 is approximately fifty percent (50%) higher than that employed to create deflection curve 86. As shown, the resulting stripping roller deflection is an outward bowing relative to the direction of the belt forces.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A shaft and loading arrangement, comprising:

a shaft rotatably mounted within a frame of an imaging machine by a pair of spaced mounting bearings;

a belt entrained on said shaft between said bearings, said belt applying a belt load to said shaft along an axial length thereof; and loading applied to said shaft at locations axially flanking said bearings to counteract deflection of said shaft caused by said belt load applied by said belt, said loading causing said shaft to convexly bend outwardly against said belt.

2. The shaft mounting and loading arrangement of claim 1, wherein said loading is applied by a connection between said shaft and said frame.

3. The shaft mounting and loading arrangement of claim 2 wherein said connection is at least one biasing member extending between said shaft and said frame.

4. The shaft mounting and loading arrangement of claim 3 wherein said at least one biasing member is a pair of springs extending between said shaft and said frame.

5. The shaft mounting and loading arrangement of claim 2, wherein loading bearings are rotatably mounted to said shaft at said locations axially flanking said mounting bearings, said loading bearings axially spaced from said mounting bearings and forming at least a portion of said connection between said shaft and said frame.

6. The shaft mounting and loading arrangement of claim 1 wherein said loading minimizes deflection of said shaft.

7. The shaft mounting and loading arrangement of claim 1 wherein said loading creates a fourth order deflection curve along said shaft.

8. The shaft and mounting arrangement of claim 1 wherein said loading is sufficient to cause said shaft to bow against said belt thereby creating a crown portion upon which said belt is tracked.

9. The shaft and mounting arrangement of claim 1 wherein said belt load is caused by said belt being under tension.

10. The shaft and mounting arrangement of claim 1 wherein said shaft has about a 20 mm to about a 25 mm diameter and said belt load is about 0.175 N/mm.

11. A xerographic device, comprising:

a belt rotatably mounted within a frame for having a latent image imparted thereon, having a toner image developed onto said latent image and transferring said toner image to a receiving sheet;

a plurality of rollers rotatably mounting and supporting said belt with said frame, said plurality of rollers including a drive roller for rotatably driving said belt, a tension roller for applying a tension to said belt and a stripper roller for facilitating separation of said receiving sheet from said belt after transfer of said toner image to said receiving sheet;

said stripper roller rotatably mounted to said frame by a pair of spaced mounting bearings between which said belt is disposed about said stripper roller;

load bearings rotatably mounted to said stripper roller and axially spaced outside said mounting bearings, said load bearings connected to said frame to reduce deflection of said stripper roller caused by said belt.

12. The xerographic device of claim 11 wherein each of said load bearings is connected to said frame by a biasing member that applies a moment load to said stripper roller that counteracts a belt load applied by said belt to said stripper roller.

13. The xerographic device of claim 12 wherein said biasing member is a spring extending between said load bearing and said frame.

14. The xerographic device of claim 13 wherein said spring sufficiently loads said stripper roller so as to minimize deflection caused by said belt under tension.

15. The xerographic device of claim 13 wherein said spring sufficiently loads said stripper roller so as to convexly deflect said stripper roller into said belt against loading applied by said belt.

16. The xerographic device of claim 11 wherein said stripper roller redirects said belt entrained thereabout thereby facilitating separation of said receiving paper moving along with said belt.

17. The xerographic device of claim 11 wherein said stripper roller is about 10 mm to about 20 mm in diameter.

18. An imaging belt mounting and loading arrangement, comprising:

an imaging belt entrained about a plurality of rollers;

one of said plurality of rollers driving said imaging belt rotatably about said plurality of rollers;

one of said plurality of rollers applying a tension to said belt to maintain frictional engagement between said belt and said plurality of rollers;

a stripper roller of said plurality of rollers sharply redirecting said belt to facilitate separation of a receiving sheet from said belt after an image is transferred from said belt to said receiving sheet, said tension on said belt urging said stripper roller to deflect in a first direction; and a loading applied to said stripper roller to urge said stripper roller to deflect in a second, opposite direction against said urging in said first direction, said loading causing said stripper roller to bow against said belt thereby creating a crown portion upon which said belt is tracked.

19. The imaging belt mounting and loading arrangement of claim 18 wherein said stripper roller is rotatably mounted by a pair of axially spaced mounting bearings and said belt is disposed between said pair of axially spaced mounting bearings, said loading urging said stripper roller to deflect in said opposite direction applied on a side of each of said mounting bearings opposite said belt to impart a moment load to said stripper roller that counteracts said belt load.

20. The xerographic device of claim 11 wherein said load bearings cause said stripper roller to bow against said belt.

* * * * *